US008007318B1

(12) United States Patent
Dunwoody et al.

(10) Patent No.: US 8,007,318 B1
(45) Date of Patent: Aug. 30, 2011

(54) SHIELDED INTEGRATED CONNECTOR MODULE

(75) Inventors: Steven David Dunwoody, Middletown, PA (US); Candace Eileen Gillette, Fremont, CA (US); David Stanley Szczesny, Hershey, PA (US); Linda Ellen Shields, Camp Hill, PA (US); Randy K. Rannow, Reno, NV (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/728,639

(22) Filed: Mar. 22, 2010

(51) Int. Cl.
*H01R 9/03* (2006.01)

(52) U.S. Cl. ..... 439/607.55; 439/676

(58) Field of Classification Search ..... 439/79, 439/607.35, 607.38, 607.4, 607.55, 676
See application file for complete search history.

(56) References Cited

U.S. PATENT DOCUMENTS

| | | | | |
|---|---|---|---|---|
| 5,639,267 | A | 6/1997 | Loudermilk | |
| 6,227,911 | B1 | 5/2001 | Boutros et al. | |
| 6,511,348 | B1 | 1/2003 | Wojtacki et al. | |
| 7,033,210 | B1 | 4/2006 | Laurer et al. | |
| 7,775,828 | B2 * | 8/2010 | Zhang | 439/540.1 |
| 7,785,135 | B2 * | 8/2010 | Wu | 439/490 |

* cited by examiner

*Primary Examiner* — Khiem Nguyen

(57) ABSTRACT

An electrical connector assembly is provided for mating with electrical plugs. The electrical connector assembly includes a housing having a top wall and a bottom wall that is opposite the top wall. The housing includes a mating face having ports that are configured to receive the electrical plugs therein. A jack sub-assembly is held by the housing. The jack sub-assembly includes jacks having electrical contacts held within the ports for engagement with the electrical plugs. The jack sub-assembly includes a signal pin array having signal pins for connection to a host circuit board. The signal pin array includes a front side extending along the bottom wall of the housing. An electrically conductive outer shield covers the top wall of the housing. The outer shield includes a bottom flap covering an end of the bottom wall of the housing. An electrically conductive bottom shield covers the bottom wall of the housing between the bottom flap of the outer shield and the front side of the signal pin array.

20 Claims, 6 Drawing Sheets

SHIELDED INTEGRATED CONNECTOR MODULE

BACKGROUND OF THE INVENTION

The subject matter described and/or illustrated herein relates generally to electrical connector assemblies, and more particularly, to shielded integrated connector modules (ICMs) that mate with a plurality of modular plugs.

Modular plugs and modular jacks, including ICMs, are widely used to provide electrical connections between devices. For example, modular plugs and modular jacks are sometimes used to connect computer equipment together. However, computer connections may generate or be susceptible to noise due to the high frequency signals which are transmitted along the communication lines between the computer and other devices. Susceptibility to noise is a particular concern in high density applications, such as in communication modules, where numerous ports must be provided for the connection of communication lines between a computer and other devices. For example, commercial network providers to the Internet typically require hundreds of communications channels. Because of the noise that may be present or generated at the interface between the modular plug and the modular jack, there may be a failure to meet system electromagnetic interference (EMI) performance requirements. Furthermore, noise may also result in system current injection (CI) failures. It is for this reason that ICMs are constructed with shielding or isolation provided between the modular jacks within the ICM. Moreover, ICMs typically include an outer shield surrounding the housing thereof to shield the ICM from electromagnetic interference (EMI) emitted by other devices, such as computers, communication lines, and/or other modular jack assemblies.

Reducing cross talk and providing higher levels of shielding have become more important because of increasing data rates, switching speeds, increasing routing complexity, decreasing space on the host circuit board, and/or lower voltage thresholds. For example, ICMs sometimes include an array of signal pins that engage the host circuit board on which the assembly is mounted. The signal pins electrically connect the host circuit board to the mating contacts of each modular jack of the ICM. However, as the density of electrical connections to the host circuit board and the speed of the signals increases, the signal pins may experience cross talk and/or receive EMI from neighboring connections on the host circuit board.

There is a need for an ICM having an increased amount of EMI shielding, a reduced amount of crosstalk and/or noise, enhanced signal pin isolation, and/or a reduced amount of radiated energy from the signal pin array.

BRIEF DESCRIPTION OF THE INVENTION

In one embodiment, an electrical connector assembly is provided for mating with electrical plugs. The electrical connector assembly includes a housing having a top wall and a bottom wall that is opposite the top wall. The housing includes a mating face having ports that are configured to receive the electrical plugs therein. A jack sub-assembly is held by the housing. The jack sub-assembly includes jacks having electrical contacts held within the ports for engagement with the electrical plugs. The jack sub-assembly includes a signal pin array having signal pins for connection to a host circuit board. The signal pin array includes a front side extending along the bottom wall of the housing. An electrically conductive outer shield covers the top wall of the housing. The outer shield includes a bottom flap covering an end of the bottom wall of the housing. An electrically conductive bottom shield covers the bottom wall of the housing between the bottom flap of the outer shield and the front side of the signal pin array.

In another embodiment, an electrical connector assembly is provided for mating with electrical plugs. The electrical connector assembly includes a housing having a top wall and a bottom wall that is opposite the top wall. The housing includes a mating face having ports that are configured to receive the electrical plugs therein. A jack sub-assembly held by the housing. The jack sub-assembly includes jacks having electrical contacts held within the ports for engagement with the electrical plugs. The jack sub-assembly includes a signal pin array having signal pins for connection to a host circuit board. The signal pin array includes a front side extending along the bottom wall of the housing. An electrically conductive bottom shield at least partially covers the bottom wall of the housing. The bottom shield includes a row of ground tabs that flanks the front side of the signal pin array.

In another embodiment, an electrical connector assembly is provided for mating with electrical plugs. The electrical connector assembly includes a housing having a top wall and a bottom wall that is opposite the top wall. The housing includes a mating face having ports that are configured to receive the electrical plugs therein. A jack sub-assembly is held by the housing. The jack sub-assembly includes jacks having electrical contacts held within the ports for engagement with the electrical plugs. The jack sub-assembly includes a signal pin array having signal pins for connection to a host circuit board. An electrically conductive outer shield at least partially covers the top wall of the housing. An electrically conductive bottom shield at least partially covers the bottom wall of the housing. The outer shield and the bottom shield cooperate to define a faraday shield around the signal pin array.

DETAILED DESCRIPTION OF THE INVENTION

Figure 1:
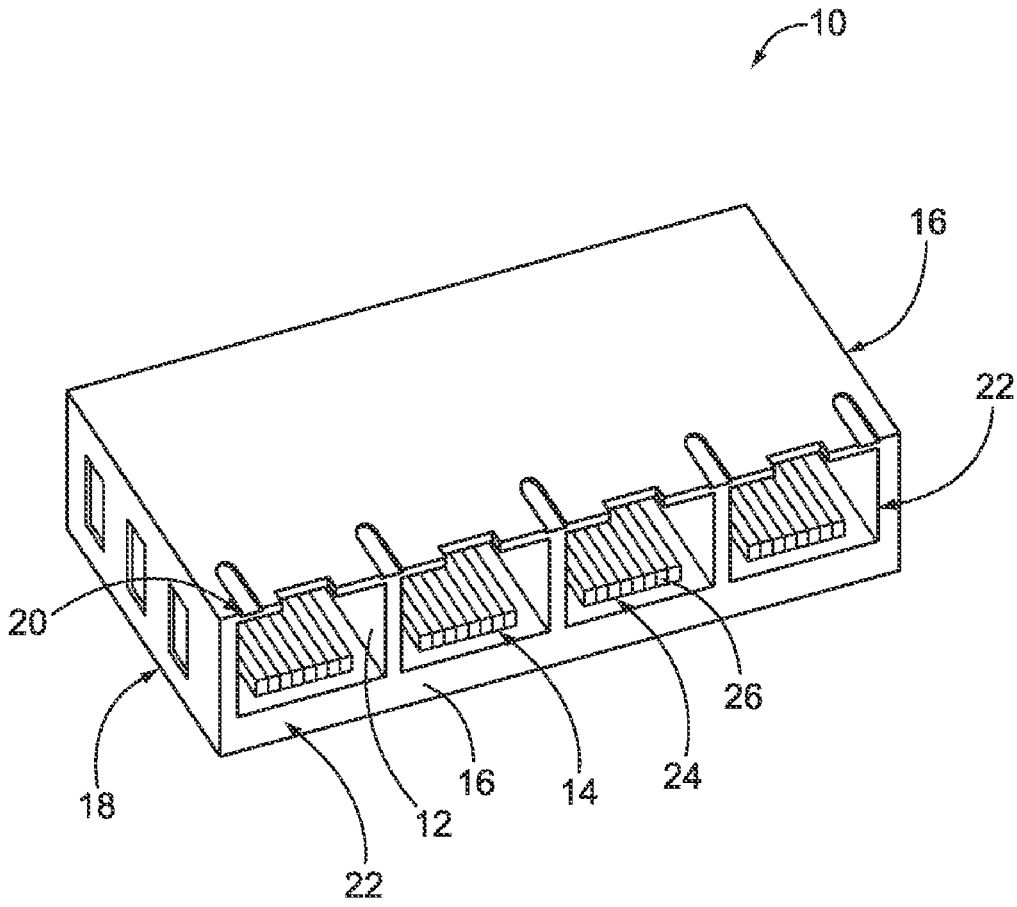
FIG. 1 is a top perspective view of an exemplary embodiment of a shielded integrated connector module (ICM).
Figure 2:
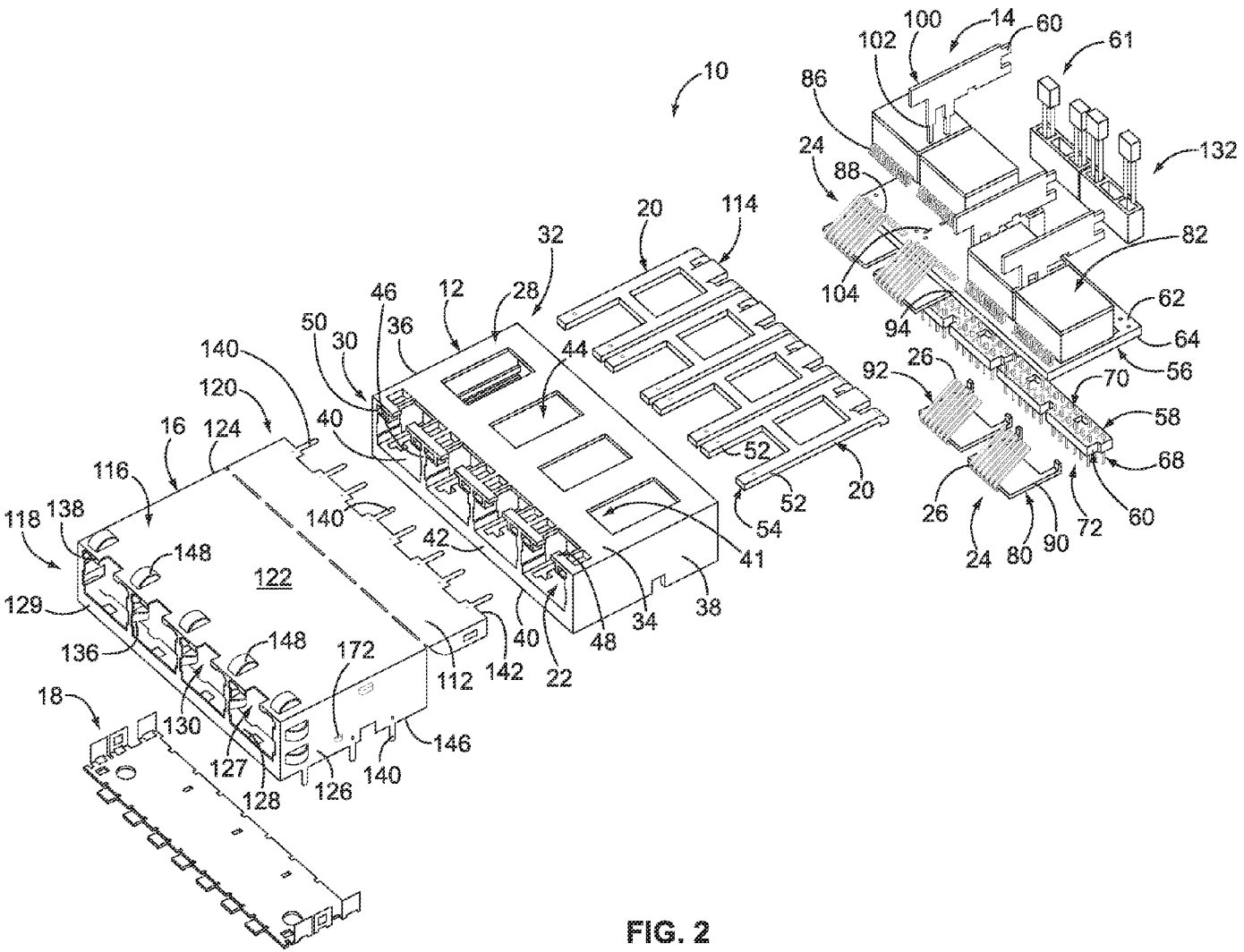
FIG. 2 is an exploded perspective view of the shielded ICM shown in FIG. 1.

FIG. 1 is a top perspective view of an exemplary embodiment of a shielded integrated connector module (ICM) 10. FIG. 2 is an exploded perspective view of the ICM 10. The ICM 10 includes a dielectric housing 12, a jack sub-assembly 14 held by the housing 12, and an electrically conductive outer shield 16 surrounding a portion of the housing 12. The ICM 10 also includes an electrically conductive bottom shield 18 and a plurality of optional light pipe members 20. The housing 12 includes a plurality of ports 22 that each receives a modular plug (not shown) therein. The jack sub-assembly 14 includes a plurality of modular jacks 24 that each includes an array of electrical contacts 26. The jack sub-assembly 14 is held by the housing 12 such that the electrical contacts 26 of each modular jack 24 extend within a corresponding one of the ports 22 for engagement with corresponding electrical contacts (not shown) of the modular plug. In the exemplary embodiment, the ICM 10 is configured to be mounted on a host circuit board (not shown). The ICM 10 may be referred to herein as an "electrical connector assembly". The modular plug may be referred to herein as an "electrical plug".

Referring now to FIG. 2, the housing 12 includes a dielectric body 28 extending a length from a front end 30 to a rear end 32. The housing body 28 includes a top wall 34 and a pair of opposite side walls 36 and 38, each of which extends from the front end 30 to the rear end 32 of the body 28. The housing body 28 also includes a bottom wall 40 that extends from the front end 30 toward the rear end 32. The walls 34, 36, 38, and 40 define a mating face 42 of the housing body 28 at the front end 30 thereof.

The bottom wall 40 extends from the mating face 42 to a rear edge 41 (best seen in FIG. 4) of the bottom wall 40. An internal cavity 44 is defined by the walls 34, 36, 38, and 40. The housing body 28 includes a plurality of divider walls 46 that divide the internal cavity 44 into the plurality of ports 22. Each port 22 is configured to receive a modular plug (not shown) therein. The top wall 34 of the housing body 28 includes a plurality of latch openings 48 that communicate with the mating face 42. The latch openings 48 define a latching structure for receiving a resilient latch (not shown) of the modular plug.

The housing body 28 includes a plurality of light pipe channels 50. In the exemplary embodiment, each light pipe channel 50 extends completely through the top wall of the housing body 28 from the front end 30 to the rear end 32. Accordingly, each light pipe channel 50 extends through the mating face 42 of the housing body 28. Each light pipe channel 50 receives a light pipe 52 of a corresponding one of the light pipe members 20 therein such that an end 54 of the corresponding light pipe 52 is held within the light pipe channel 50 adjacent the mating face 42 of the housing body 28. The ends 54 of the light pipes 52 are thereby visible when facing the mating face 42 of the housing body 28.

Although one row of four ports 22 is shown, the housing 12 may include any number of ports 22 for receiving any number of modular plugs. Moreover, the housing 12 may include any number of rows and/or columns of ports 22. In the exemplary embodiment, the housing body 28 includes eight light pipe channels 50, wherein each port 22 has two of the light pipe channels 50 associated therewith. However, the housing body 28 may include any number of the light pipe channels 50 for receiving any number of light pipes 52. Moreover, each port 22 may have any number of light pipe channels 50 associated therewith. Furthermore, in addition or alternative to extending through the top wall 34 of the housing body 28, one or more of the light pipe channels 50 may extend through the bottom wall 40, the side wall 36, and/or the side wall 38.

Figure 3:
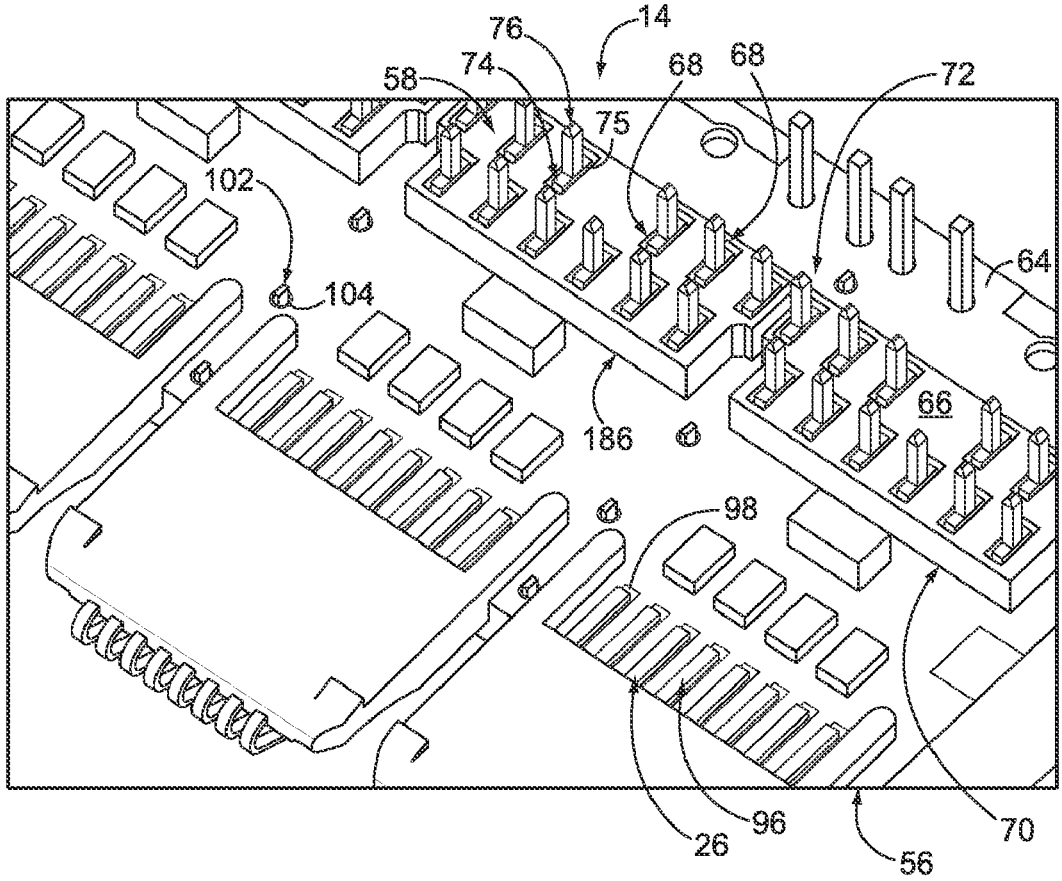
FIG. 3 is a perspective view of a portion of an exemplary embodiment of a jack sub-assembly of the shielded ICM shown in FIGS. 1 and 2.

The jack sub-assembly 14 includes a circuit board 56, a signal pin array 58 mounted on the circuit board 56 for connecting the circuit board 56 to the host circuit board, the plurality of jacks 24, a plurality of electrically conductive inner shields 60, and a plurality of optional light emitting diodes (LEDs) 61. The circuit board 56 includes a top surface 62 and a bottom surface 64 that is opposite the top surface 62. The signal pin array 58 includes a holder 66 and a plurality of signal pins 68 held by the holder 66. Specifically, the holder 66 includes a mounting side 70 and an opposite side 72. The mounting side 70 is mounted on the bottom surface 64 of the circuit board. FIG. 3 is a perspective view of a portion of the jack sub-assembly 14 illustrating the bottom surface 64 of the circuit board 56. Each signal pin 68 includes a base 74 held within a corresponding opening 75 of the holder 66, and a pin 76 extending outwardly from the base 74. The base 74 of each signal pin 68 is held by the holder 66 such that the base 74 is exposed on the mounting side 70 of the holder 66. The pin 76 extends outwardly from the side 72 of the holder 66. When the mounting side 70 of the holder 66 is mounted on the bottom surface 64 of the circuit board 56, the base 74 of each signal pin 68 is engaged with and electrically connected to a corresponding electrical contact (not shown) of the circuit board 56. Moreover, the pins 76 extend outwardly from the bottom surface 64 of the circuit board 56. When the ICM 10 is mounted on the host circuit board, the pin 76 of each signal pin 68 is engaged with and electrically connected to a corresponding electrical contact (not shown) of the host circuit board.

Figure 4:
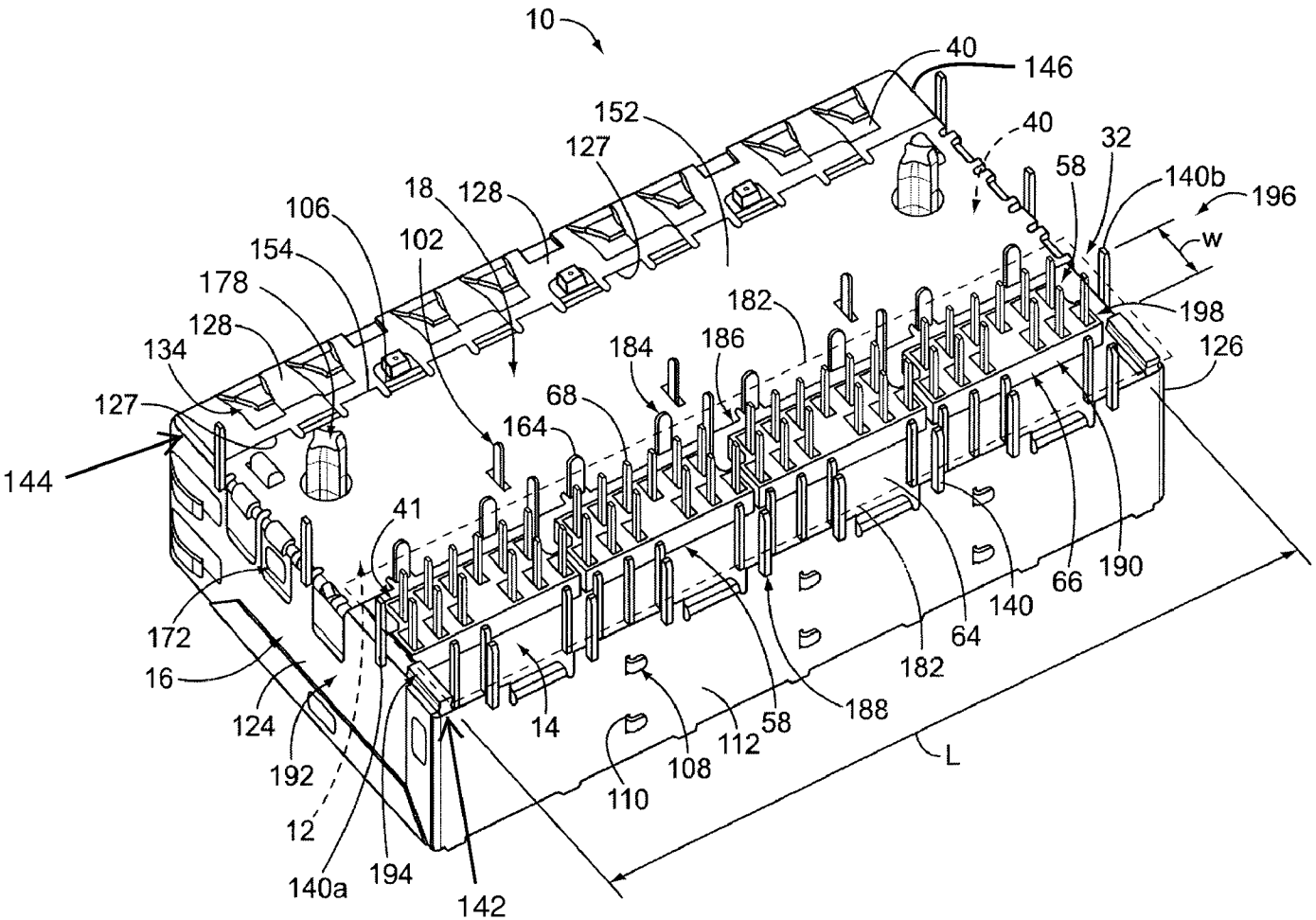
FIG. 4 is a bottom perspective view of the shielded ICM shown in FIGS. 1 and 2.

FIG. 4 is a bottom perspective view of the ICM 10. When the ICM 10 is assembled, as is shown in FIG. 4, the jack sub-assembly 14 is held by the housing 12 and the housing 12 is held by the outer shield 16 and the bottom shield 18. The signal pin array 58 is exposed at the rear end 32 of the housing 12. Specifically, the bottom surface 64 of the circuit board 56 (FIG. 2) includes the signal pin array 58, which extends along the bottom wall 40 of the housing 12. When the ICM 10 is assembled, the signal pin array 58 is exposed at the rear end 32 of the housing 12 along and adjacent the rear edge 41 of the bottom wall 40 of the housing 12. Accordingly, a front side 186 of the signal pin array 58 extends along and adjacent the rear edge 41 of the bottom wall 40 of the housing 12. Moreover, the signal pin array 58 can be considered to extend along a width of the bottom wall 40 of the housing 12. In the exemplary embodiment, a periphery of the signal pin array 58 is defined by a width W and length L of the holder 66. Alternatively, a periphery of the signal pin array 58 is defined by another structure (such as, but not limited to, one or more of the signal pins 68) in addition or alternative to the holder 66 and/or is defined by another geometry of the holder 66 in addition or alternative to the length L and/or width W of the holder 66. Although the holder 66 is shown as having a rectangular shape, the holder 66 may include any shape in addition or alternative to the rectangular shape. Moreover, the periphery of the signal pin array 58 may include any shape in addition or alternative to rectangular.

Figure 5:
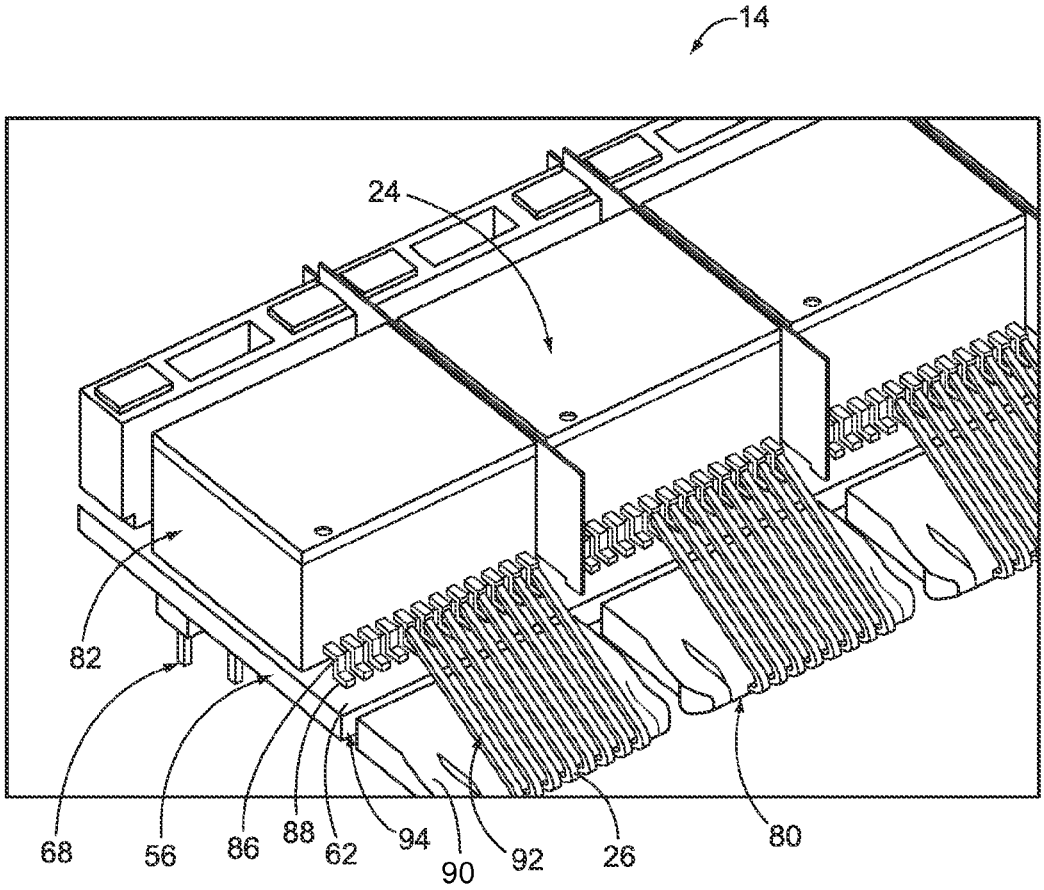
FIG. 5 is a front perspective view of a portion of the jack sub-assembly shown in FIG. 3.

FIG. 5 is a front perspective view of a portion of the jack sub-assembly 14. Referring now to FIGS. 2 and 5, each modular jack 24 includes a contact sub-assembly 80 and a signal conditioning module 82. In the exemplary embodiment, each signal conditioning module 82 is mounted on the top surface 62 of the circuit board 56. Each signal conditioning module 82 includes a plurality of electrical contacts 86 that are each electrically connected to a corresponding electrical contact 88 of the circuit board 56. Moreover, each signal conditioning module 82 is electrically connected to the signal pins 68 via electrical traces (not shown) and/or electrical contacts (not shown) of the circuit board 56.

Each contact sub-assembly 80 includes a base 90 that holds the array of electrical contacts 26. Each electrical contact 26 includes a mating interface 92 for engagement with the corresponding electrical contact of the modular plug. Specifically, when the jack sub-assembly 14 is held by the housing 12, the mating interfaces 92 extend within the corresponding port 22. The base 90 of each contact sub-assembly 80 is mounted on the circuit board 56 such that the contact sub-assemblies 80 extend outwardly from a front edge 94 of the circuit board 56. Referring again to FIG. 3, each electrical contact 26 includes a mounting end 96 that is engaged with, and electrically connected to, a corresponding electrical contact 98 of the circuit board 56. The electrical contacts 26 are each electrically connected to the corresponding electrical contact 86 of the corresponding signal conditioning module 82 via a corresponding electrical trace (not shown) and/or electrical contact (not shown) of the circuit board 56 that electrically connects corresponding electrical contacts 88 and 98 of the circuit board 56 together. The contact sub-assembly 80 of each modular jack 24 may include any number of electrical contacts 26.

Referring again to FIGS. 2 and 5, each inner shield 60 extends between two adjacent modular jacks 24 for shielding the modular jacks 24 from each other. As can be seen in FIG. 2, each inner shield 60 includes a shield body 100 and a plurality of ground fingers 102 that extend outwardly from the shield body 100. Each ground finger 102 extends through a corresponding via 104 within the circuit board 56 to electrically connect the ground finger 102, and thus the inner shield 60, to a ground plane of the circuit board 56. Referring again to FIG. 3, each ground finger 102 extends through the corresponding via 104 and outwardly from the bottom surface 64 of the circuit board 56. As can be seen in FIG. 4, each ground finger 102 extends through a corresponding opening 106 within the bottom shield 18 and outwardly therefrom for engagement with, and electrical connection to, the host circuit board. The ground finger 102 may engage a portion of the bottom shield 18 that defines the corresponding opening 106 such that the ground finger 102, and thus the inner shield 60, is electrically connected to the bottom shield 18. In some embodiments, one or more of the ground fingers 102 is soldered to the bottom shield 18. Each inner shield 60 may include any number of ground fingers 102. In some embodiments, the ground finger 102 that extends closest to the front face 129 of the shield body 116 is positioned as close as possible to the 129 to, for example, reduce loop inductance.

Figure 6:
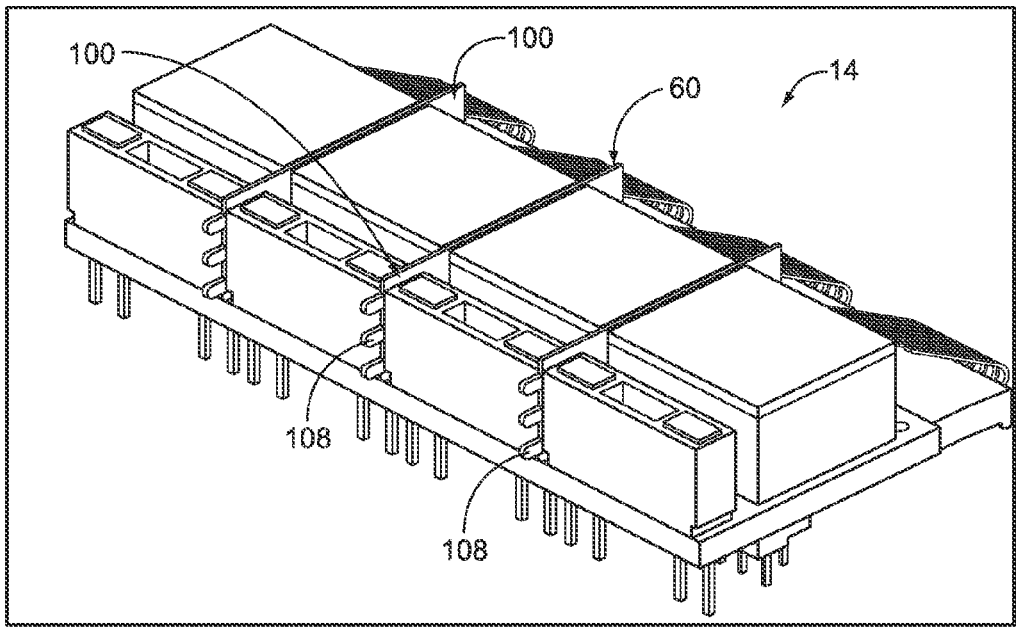
FIG. 6 is a rear perspective view of a portion of the jack sub-assembly shown in FIGS. 3 and 5.

FIG. 6 is a rear perspective view of a portion of the jack sub-assembly 14. Each inner shield 60 includes a plurality of ground tabs 108 that extend outwardly from the shield body 100. As can be seen in FIG. 4, each ground tab 108 extends through a corresponding opening 110 within a rear wall 112 of the outer shield 16. Each ground tab 108 is bent into engagement with, and thereby electrical connection to, the rear wall 112 of the outer shield 16. Accordingly, each inner shield 60 is electrically connected to the rear wall 112 of the outer shield 16. In some embodiments, one or more of the ground tabs 108 is soldered to the rear wall 112 of the outer shield 16. Each inner shield 60 may include any number of ground tabs 108.

Referring again to FIG. 2, in the exemplary embodiment, the plurality of LEDs 61 are mounted on the top surface 62 of the circuit board 56. Each LED 61 engages a mating end 114 of the corresponding light pipe member 20 for emitting light through the light pipes 52 thereof. The light emitted through the light pipes 52 is visible at the end 54 of the light pipe 52 that is held adjacent the mating face 42 of the housing body 28.

The outer shield 16 includes an electrically conductive body 116 extending a length from a front end 118 to a rear end 120. The outer shield body 116 includes a top wall 122, a pair of opposite side walls 124 and 126, and the rear wall 112. Each of the side walls 124 and 126 extends from the front end 118 to the rear end 120 of the outer shield body 116. The outer shield body 116 also includes a bottom flap 128 that extends from the front end 118 toward the rear end 120. Specifically, the bottom flap 128 extends from the front end 118 to a rear edge 127 of the bottom flap 128. The outer shield body 116 includes a front face 129 at the front end 118 thereof. An internal cavity 130 is defined by the flap 128 and the walls 122, 124, 126, and 112. When the ICM 10 is assembled, the housing 12 is held within the internal cavity 130 such that the top wall 122 of the outer shield body 116 covers at least a portion of the top wall 34 of the housing 12. Moreover, the side walls 124 and 126 each cover at least a portion of the side walls 36 and 38, respectively, of the housing 12. The rear wall 112 covers a rear end 132 of the jack sub-assembly 14, while the bottom flap 128 covers a front end 134 (FIG. 4) of the bottom wall 40 of the housing 12.

The outer shield body 116 includes a plurality of port openings 136 within the front face 129. Each port opening 136 exposes a corresponding one of the ports 22 through the front face 129 to enable the modular plug to be received through the front face 129 and into the corresponding port 22. In the exemplary embodiment, each port opening 136 includes one or more optional recesses 138 that expose a corresponding one of the light pipe channels 50 of the housing 12 to enable the end 54 of the corresponding light pipe 52 to be visible through the front face 129 of the outer shield body 116. The outer shield 16 may include any number of the port openings 136 for exposing any number of the ports 22. Moreover, the outer shield 16 may include any number of recesses 138 for exposing any number of light pipe channels 50.

A plurality of ground fingers 140 extend outwardly from a bottom edge 142 of the rear wall 112 and from bottom edges 144 (FIG. 4) and 146 of the side walls 124 and 126, respectively. When the ICM 10 is mounted on the host circuit board, the ground fingers 140 are engaged with, and electrically connected to, the host circuit board. The outer shield body 116 optionally includes a plurality of spring members 148 at the front end 118 of the body 116. When the ICM 10 is mounted within the opening (not shown) of a panel (not shown), the spring members 148 engage the panel to facilitate holding the ICM 10 within the opening. The outer shield 16 may include any number of the ground fingers 140.

Figure 7:
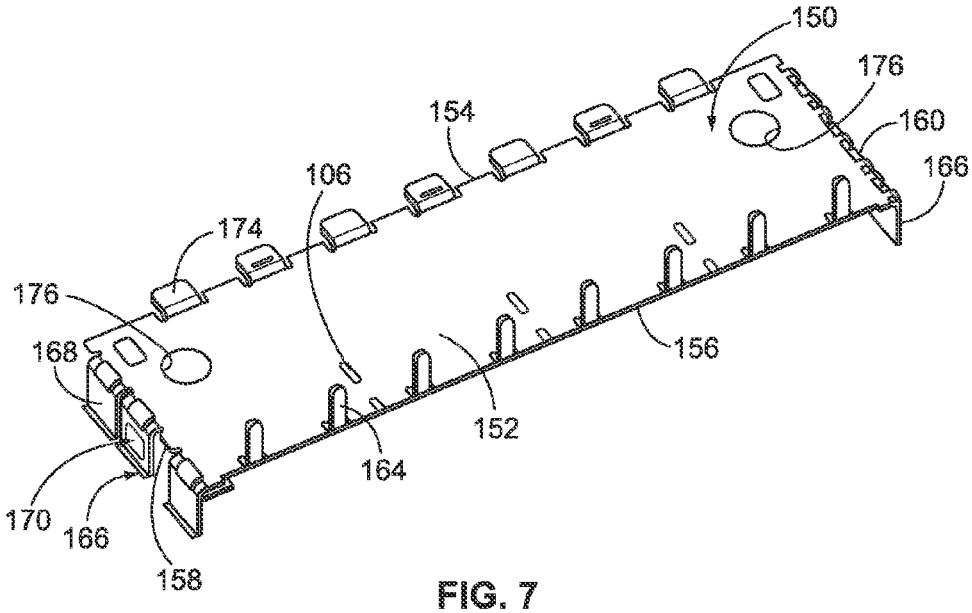
FIG. 7 is a perspective view of an exemplary embodiment of a bottom shield of the shielded ICM shown in FIGS. 1, 2, and 4.

FIG. 7 is a perspective view of an exemplary embodiment of the bottom shield 18. The bottom shield 18 includes an electrically conductive body 150 having a base 152. The bottom shield body 150 is a discrete component of the ICM 10 relative to the outer shield 16 (FIGS. 1, 2, and 4). The base 152 extends from a front edge 154 to an opposite rear edge 156, and from a side edge 158 to an opposite side edge 160. When the ICM 10 is assembled, the base 152 covers the bottom wall 40 (FIGS. 1 and 4) of the housing 12 (FIGS. 1, 2, and 4) at least partially between the rear edge 127 (FIG. 4) of the bottom flap 128 (FIGS. 2 and 4) and the front side 186 (FIGS. 3 and 4) of the signal pin array 58 (FIGS. 2-4). A plurality of ground tabs 164 extend outwardly from the rear edge 156 of the base 152. When the ICM 10 is mounted on the host circuit board, the ground tabs 164 are engaged with, and electrically connected to, the host circuit board. The bottom shield 18 may include any number of the ground tabs 164. In some embodiments, the number of ground tabs 164 may be selected to be electrically continuous along the front side 186 of the signal pin array 58. In some embodiments, the number of ground tabs 164 may be selected to bear a predetermined relations ship (such as, but not limited to as close as possible, less than, greater than, approximately equal, and/or the like) to an operating frequency of interest.

In the exemplary embodiment, a latch extension 166 and a plurality of ground extensions 168 extend outwardly from each of the side edges 158 and 160. The latch extension 166 and each ground extension 168 extending from the side edge 158 engages the side wall 124 (FIG. 2) of the outer shield 16.

Similarly, the latch extension 166 and the ground extensions 168 extending from the side edge 160 engage the side wall 126 of the outer shield 16. Engagement of the latch extensions 166 and the ground extensions 168 with the side walls 124 and 126 electrically connects the bottom shield 18 to the outer shield 16. Each of the latch extensions 166 includes a hook 170 that engages a corresponding extension 172 (FIGS. 2 and 4) of the outer shield 16 to facilitate latching the outer shield 16 and the bottom shield 18 together. The bottom shield 18 may include any number of the latch extensions 166 and any number of the ground extensions 168. In some embodiments, the number of latch extensions 166 may be selected to be electrically continuous along the side walls 124 and 126 of the shield body 116. In some embodiments, the number of latch extensions 166 may be selected to bear a predetermined relations ship (such as, but not limited to as close as possible, less than, greater than, approximately equal, and/or the like) to an operating frequency of interest.

A plurality of ground extensions 174 extend outwardly from the front edge 154. The ground extensions 174 engage the bottom flap 128 (FIGS. 2 and 4) of the outer shield 16 to electrically connect the bottom shield 18 to the outer shield 16. As discussed above, the base 152 includes the openings 106 that receive the ground tabs 108 (FIGS. 2-4) of the inner shields 60 (FIGS. 2, 5, and 6). Moreover, the base 152 optionally includes one or more openings 176 extending therethrough. In the exemplary embodiment, the openings 176 each receive a corresponding latch post 178 (FIG. 4) extending from the bottom wall 40 of the housing 12 in a snap-fit arrangement to facilitate holding the bottom shield 18 on the housing 12. The bottom shield 18 may include any number of the ground extensions 174, any number of the openings 106 for receiving any number of the ground tabs 108, and any number of the openings 176 for receiving any number of latch posts 178.

Referring now to FIG. 4, the outer shield 16 and the bottom shield 18 cooperate to enclose the modular jacks 24. Specifically, the outer shield 16 and the bottom shield 18 cooperate to enclose the top wall 34, the side walls 36 and 38, and the bottom wall 40 of the housing 12. As discussed above, the base 152 of the bottom shield 18 covers the bottom wall 40 of the housing 12 at least partially between the rear edge 127 of the bottom flap 128 and the front side 186 of the signal pin array 58. In the exemplary embodiment, the base 152 of the bottom shield 18 covers the bottom wall 40 of the housing 12 from the rear edge 127 of the bottom flap 128 to the front side 186 of the signal pin array 58 (and thus to the rear edge 41 of the bottom wall 40). Alternatively, some or all of a width of the base 152 (defined between the side edges 158 and 160 thereof) covers the bottom wall 40 of the housing 12 along only a portion of the distance from the rear edge 127 of the bottom flap 128 to the front side 186 of the signal pin array 58. There may or may not be a gap between the rear edge 127 of the bottom flap 128 of the outer shield 16 and the front edge 154 of the bottom shield 18. Moreover, there may or may not be a gap between the rear edge 156 of the bottom shield 18 and the front side 186 of the signal pin array 58. In some embodiments, the front edge 154 of the bottom shield 18 overlaps the rear edge 127 of the bottom flap 128 of the outer shield 16, whether the bottom shield 18 overlaps the bottom flap 128 over or under the bottom flap 128.

The ground tabs 164 of the bottom shield 18 and the ground fingers 140 of the outer shield 16 cooperate to define a faraday shield 182 around the signal pin array 58. Specifically, the ground tabs 164 of the bottom shield 18 form a row 184 that flanks the front side 186 of the signal pin array 58. The row 184 of the ground tabs 164 may reduce or eliminate noise coupled by stray capacitance as electrical coupling. The ground fingers 140 extending from the rear wall 112 of the outer shield 16 form a row 188 that flanks a rear side 190 of the signal pin array 58. A ground finger 140*a* that extends from the side wall 124 of the outer shield 16 forms a row 192 that flanks a side 194 of the signal pin array 58, while a ground finger 140*b* that extends from the side wall 126 of the outer shield 16 forms a row 196 that flanks a side 198 of the signal pin array 58. In the exemplary embodiment, when connected to a source of electrical ground, the grounds tabs 164, the ground fingers 140, the ground finger 140*a*, and the ground finger 140*b* each form a portion of a faraday shield that extends around the entire periphery of the signal pin array 58. For example, the row 184 of ground tabs 164 forms a faraday shield that extends along, and thereby flanks, the front side 186 of the signal pin array 58. Moreover, the row 188 of the ground fingers 140 forms a faraday shield that extends along, and thereby flanks, the rear side 190 of the signal pin array 58. The row 192 of the ground finger 140*a* extends along, and thereby flanks, the side 194 of the signal pin array 58, while the row 196 of the ground finger 140*b* extends along, and thereby flanks, the side 198 of the signal pin array 58. The flanking rows 184, 188, 192, and 196 thereby surround the signal pin array 58.

Although each of the rows 192 and 196 includes only a single ground finger 140 in the exemplary embodiment, each of the rows 184, 188, 192, and 196 may be formed by any number of the respective ground tabs 164 and ground fingers 140. In the exemplary embodiment, the ground tabs 164 within the row 184 are spaced apart from each other along the front side 186 of the signal pin array 58. Similarly, the ground fingers 140 within the row 188 are spaced apart from each other along the rear side 190 of the signal pin array 58. The number of ground tabs 164 within the row 184 and/or the spacing between adjacent ground tabs 164 within the row 184 may be selected to provide shielding for a predetermined wavelength of electromagnetic interference (EMI). The spacing between adjacent ground tabs 164 within the row 184 may or may not be consistent within the row 184. Similarly, the number of ground fingers 140 within each of the rows 188, 192, and 196 and/or the spacing between adjacent ground fingers 140 within the rows 188, 192, and 196 may be selected to provide shielding for a predetermined wavelength of electromagnetic interference (EMI). The spacing between adjacent ground fingers 140 within each of the rows 188, 192, and 196 may or may not be consistent within the row.

In the exemplary embodiment, each of the ground tabs 164 and each of the ground fingers 140 extends approximately parallel, and thus in a common direction, to each of the signal pins 68. Alternatively, one or more of the grounds tabs 164 and/or one or more of the ground fingers 140 may extend at any other angle relative to one or more of the signal pins 68, such as, but not limited to, approximately perpendicular, an oblique angle, and/or the like.

The embodiments described and/or illustrated herein provide a modular jack assembly that may have an increased amount of EMI shielding, a reduced amount of crosstalk, and/or a reduced amount of noise. For example, the embodiments described and/or illustrated may reduce cross talk, may reduce noise, and/or may increase EMI shielding by providing a faraday shield around at least a portion of a signal pin array of the modular jack assembly. Moreover, and for example, the embodiments described and/or illustrated herein may reduce crosstalk, may reduce noise, and/or may increase EMI shielding by providing an increased number of ground connections to inner shields that separate adjacent jacks of the modular jack assembly. The embodiments described and/or illustrated herein may provide a modular jack assembly that has a desired, acceptable, and/or required level of EMI shielding, noise levels, and/or crosstalk amounts for a system operating at speeds up to 10 gigabits. The embodiments described and/or illustrated herein may reduce or eliminate noise coupled by stray capacitance as electrical coupling.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Similarly, the terms "front", "rear", "top", "bottom", and "side" etc. in the claims are used merely as labels, and are not intended to impose orientational requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector assembly for mating with electrical plugs, said electrical connector assembly comprising:

a housing comprising a top wall and a bottom wall that is opposite the top wall, the housing comprising a mating face having ports that are configured to receive the electrical plugs therein;

a jack sub-assembly held by the housing, the jack sub-assembly comprising jacks having electrical contacts held within the ports for engagement with the electrical plugs, the jack sub-assembly comprising a signal pin array comprising signal pins for connection to a host circuit board, the signal pin array having a front side extending along the bottom wall of the housing;

an electrically conductive outer shield at least partially covering the top wall of the housing, the outer shield comprising a bottom flap covering an end of the bottom wall of the housing; and an electrically conductive bottom shield covering the bottom wall of the housing at least partially between the bottom flap of the outer shield and the front side of the signal pin array.

2. The electrical connector assembly according to claim 1, wherein the bottom wall of the housing comprises a rear edge, the bottom shield covering the bottom wall of the housing from the bottom flap of the outer shield to the rear edge of the bottom wall of the housing.

3. The electrical connector assembly according to claim 1, wherein the bottom shield covers the bottom wall of the housing from the bottom flap of the outer shield to the front side of the signal pin array.

4. The electrical connector assembly according to claim 1, wherein the outer shield and the bottom shield cooperate to enclose the jacks.

5. The electrical connector assembly according to claim 1, wherein the bottom shield is engaged with and electrically connected to the outer shield.

6. The electrical connector assembly according to claim 1, wherein the bottom shield comprises a row of ground tabs that flanks the front side of the signal pin array.

7. The electrical connector assembly according to claim 1, wherein the outer shield and the bottom shield cooperate to define a faraday shield around the signal pin array.

8. The electrical connector assembly according to claim 1, wherein the bottom shield comprises ground tabs and the outer shield comprises ground fingers, the ground tabs and ground fingers being spaced apart along a periphery of the signal pin array to define a faraday shield around the signal pin array.

9. The electrical connector according to claim 1, wherein the bottom shield comprises a row of ground tabs that flank the front side of the signal pin array, and wherein the ground tabs are spaced apart from one other along the front side of the signal pin array.

10. The electrical connector assembly according to claim 1, wherein the bottom shield comprises a row of ground tabs that flank the front side of the signal pin array, and wherein at least some of the ground tabs extend in a common direction relative to the signal pins.

11. The electrical connector assembly according to claim 1, wherein the signal pin array comprises a rear side that is opposite the front side, the bottom shield comprising a row of ground tabs that flank the front side of the signal pin array, the outer shield comprising a row of ground fingers that flank the rear side of the signal pin array.

12. The electrical connector assembly according to claim 1, further comprising an electrically conductive inner shield extending between two adjacent jacks, the inner shield being electrically connected to at least one of the outer shield and the bottom shield.

13. The electrical connector assembly according to claim 1, further comprising an electrically conductive inner shield extending between two adjacent jacks, the jack sub-assembly comprising a circuit board, the inner shield being configured to be electrically connected to at least one of the circuit board of the jack sub-assembly and the host circuit board.

14. An electrical connector assembly for mating with electrical plugs, said electrical connector assembly comprising:

a housing comprising a top wall and a bottom wall that is opposite the top wall, the housing comprising a mating face having ports that are configured to receive the electrical plugs therein;

a jack sub-assembly held by the housing, the jack sub-assembly comprising jacks having electrical contacts held within the ports for engagement with the electrical plugs, the jack sub-assembly comprising a signal pin array comprising signal pins for connection to a host circuit board, the signal pin array having a front side extending along the bottom wall of the housing; and an electrically conductive bottom shield at least partially covering the bottom wall of the housing, wherein the bottom shield comprises a row of ground tabs that flanks the front side of the signal pin array.

15. The electrical connector assembly according to claim 14, wherein the ground tabs are spaced apart from one other along the front side of the signal pin array.

16. The electrical connector assembly according to claim 14, wherein the ground tabs define a faraday shield around the front side of the signal pin array.

17. The electrical connector assembly according to claim 14, further comprising an electrically conductive outer shield at least partially covering the top wall of the housing, the outer shield and the bottom shield cooperating to define a faraday shield around the signal pin array.

18. The electrical connector assembly according to claim 14, further comprising an electrically conductive outer shield at least partially covering the top wall of the housing, the outer shield comprising ground fingers, the ground tabs and ground fingers being spaced apart along a periphery of the signal pin array to define a faraday shield around the signal pin array.

19. The electrical connector assembly according to claim 1, further comprising an electrically conductive outer shield at least partially covering the top wall of the housing, wherein the signal pin array comprises a rear side that is opposite the front side, the outer shield comprising a row of ground fingers that flank the rear side of the signal pin array.

20. An electrical connector assembly for mating with electrical plugs, said electrical connector assembly comprising:

a housing comprising a top wall and a bottom wall that is opposite the top wall, the housing comprising a mating face having ports that are configured to receive the electrical plugs therein;

a jack sub-assembly held by the housing, the jack sub-assembly comprising jacks having electrical contacts held within the ports for engagement with the electrical plugs, the jack sub-assembly comprising a signal pin array comprising signal pins for connection to a host circuit board;

an electrically conductive outer shield at least partially covering the top wall of the housing; and an electrically conductive bottom shield at least partially covering the bottom wall of the housing, wherein the outer shield and the bottom shield cooperate to define a faraday shield around the signal pin array.

* * * * *